US009063513B2

(12) United States Patent
Kobayashi et al.

(10) Patent No.: US 9,063,513 B2
(45) Date of Patent: Jun. 23, 2015

(54) IMAGE FORMING APPARATUS

(71) Applicant: FUJI XEROX CO., LTD., Tokyo (JP)

(72) Inventors: Takahiko Kobayashi, Kanagawa (JP); Masanori Seto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/204,214

(22) Filed: Mar. 11, 2014

(65) Prior Publication Data

US 2015/0023693 A1 Jan. 22, 2015

(30) Foreign Application Priority Data

Jul. 17, 2013 (JP) ..... 2013-148172

(51) Int. Cl.
*G03G 21/16* (2006.01)

(52) U.S. Cl.
CPC ..... *G03G 21/1671* (2013.01); *G03G 21/1666* (2013.01); *G03G 21/1647* (2013.01)

(58) Field of Classification Search
USPC ..... 399/116
See application file for complete search history.

(56) References Cited

U.S. PATENT DOCUMENTS

2009/0190953 A1 7/2009 Okabe

FOREIGN PATENT DOCUMENTS

| | | |
|---|---|---|
| EP | 2 431 817 A1 | 3/2012 |
| JP | A-2009-175416 | 8/2009 |
| JP | A-2011-20414 | 2/2011 |
| JP | A-2012-63515 | 3/2012 |

*Primary Examiner* — Clayton E Laballe
*Assistant Examiner* — Jas Sanghera
(74) *Attorney, Agent, or Firm* — Oliff PLC

(57) ABSTRACT

An image forming apparatus includes a housing, an image carrying body, an exposure device, a detachable body, and a movement device. The image carrying body installed in the housing carries an image formed on its surface. The exposure device is movable between exposure and retracted positions. The surface of the image carrying body is exposed to light at the exposure position. A distance between an installation position where the image carrying body is installed in the housing and the retracted position is larger than a distance between the installation position and the exposure position. The image carrying body is disposed in the detachable body attachable to and detachable from the housing. The movement device provided in the detachable body causes the exposure device to move from the retracted position side to the exposure position side along with a movement of the detachable body being inserted into the housing.

6 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2013-148172 filed Jul. 17, 2013.

BACKGROUND (i) Technical Field

The present invention relates to an image forming apparatus.

(ii) Related Art

It is known that, in some related-art image forming apparatuses, the surface of a photoconductor layer is exposed to light emitted from light emitting diodes (LEDs).

SUMMARY

According to an aspect of the present invention, an image forming apparatus includes a housing, an image carrying body, an exposure device, a detachable body, and a movement device. The image carrying body has a surface, is installed in the housing, and carries an image formed on the surface thereof. The exposure device is movable between an exposure position and a retracted position. The surface of the image carrying body is exposed to light at the exposure position. A distance between an installation position where the image carrying body is installed in the housing and the retracted position is larger than a distance between the installation position and the exposure position. The detachable body, in which the image carrying body is disposed, is attachable to and detachable from the housing. The movement device is provided in the detachable body. The movement device causes the exposure device to move from the retracted position side to the exposure position side along with a movement of the detachable body being inserted into the housing.

BRIEF DESCRIPTION OF THE DRAWINGS

Exemplary embodiment of the present invention will be described in detail based on the following figures, wherein.

DETAILED DESCRIPTION

A specific exemplary embodiment of an image forming apparatus according to the present invention will be described below with reference to the drawings.

Figure 1:
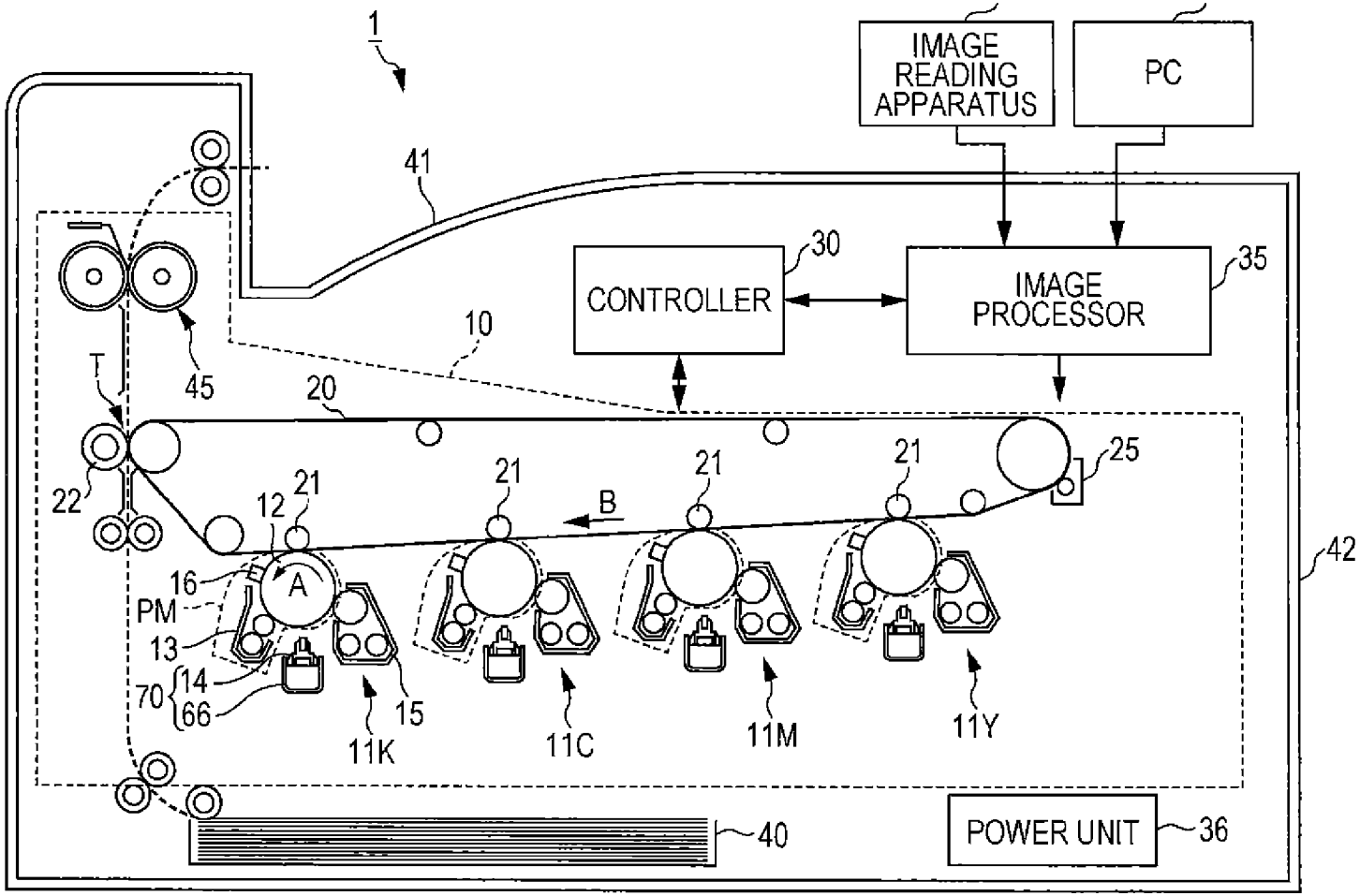
FIG. 1 illustrates a general configuration of a printer that corresponds to an exemplary embodiment of an image forming apparatus.

FIG. 1 illustrates a general configuration of a printer that corresponds to an exemplary embodiment of an image forming apparatus.

A printer 1 illustrated in FIG. 1, which is a so-called tandem-type color printer, includes an image formation processing section 10, a controller 30, an image processor 35, and a power unit 36. The image formation processing section 10 forms images corresponding to color image data. The controller 30 controls operations of the entire printer 1. The image processor 35 is connected to external devices such as, for example, a personal computer (PC) 3 and an image reading apparatus 4 and performs image processing on image data received from these external devices. The power unit 36 supplies power to components of the printer 1. The image formation processing section 10, the controller 30, the image processor 35, and the power unit 36 are disposed in a housing 42.

The housing 42 includes a covering portion formed of plastic and a frame portion. An external shape of the printer 1 is generally defined by the cover portion. The frame portion generally serves as a frame of the printer 1 and holds the entire structure of the printer 1. Part of the housing 42 is openable. When this openable part is opened by an operation performed by a user, an opening is formed on the front side of the page of FIG. 1 (front side), thereby exposing the interior of the printer 1. Part of the image formation processing section 10 is detachable from the housing 42 through the opening for convenience of maintenance and the like. A specific example of the detachable part will be described later.

The image formation processing section 10 includes four image forming units 11Y, 11M, 11C, and 11K (alternatively, these may be generally simply referred to as "image forming units 11" hereafter), which are arranged substantially parallel to one another and spaced apart from one another by a certain pitch. Each image forming units 11 includes a photoconductor drum 12, a charger 13, an LED print head (LPH) 14, a developing device 15, and a cleaner 16. An electrostatic latent image and a toner image are formed on the surface of the photoconductor drum 12. The surface of the photoconductor drum 12 is charged by the charger 13. The surface of the photoconductor drum 12 is exposed to light in accordance with image data by the LPH 14. An electrostatic latent image formed on the photoconductor drum 12 is developed by the developing device 15. The surface of the photoconductor drum 12 is cleaned by the cleaner 16 after an image has been transferred. The photoconductor drum 12 of the present exemplary embodiment includes a rotational shaft (not illustrated in FIG. 1) and is disposed such that the axial direction of the rotational shaft extends from the front side of the printer 1 (front side of the page of FIG. 1) to the rear side of the printer 1 (rear side of the page of FIG. 1). The LPH 14 is held by a metal holding body, thereby forming an LPH unit 70 as will be described in detail later.

The photoconductor drum 12 corresponds to an example of an image carrying body of the present invention, and the LPH unit 70 corresponds to an example of an exposure device of the present invention.

Here, in each of the image forming units 11, the photoconductor drum 12, the charger 13, and the cleaner 16 are integrated with one another to form a module (referred to as a photoconductor module PM hereafter). The photoconductor module PM is detachably attached to the housing 42 of the printer 1 and replaced in accordance with the life or the like of the photoconductor drum 12. The photoconductor module PM may be a module that includes only the photoconductor drum 12 and does not include the charger 13 and the cleaner 16. Alternatively, the photoconductor module PM may be a module into which the developing device 15 is also integrated in addition to the charger 13 and the cleaner 16. That is, as long as the photoconductor drum 12 is included, the photoconductor module PM may be a combination of any components. In the present exemplary embodiment, it is assumed that the photoconductor module PM and the LPH 14 are separated from each other. The photoconductor module PM corresponds to an example of a detachable body of the present invention.

When the photoconductor module PM is attached to or detached from the printer 1, the LPH unit 70 that includes the LPH 14 is advanced to an exposure position or retracted to a retracted position. The photoconductor drum 12 is exposed to light at the exposure position. At the retracted position, the LPH unit 70 is further away from the photoconductor drum 12 than it is at the exposure position. As will be described in detail later, the photoconductor module PM includes therein a member, which draws the LPH 14 when the photoconductor module PM is inserted into the printer 1 so as to advance the LPH 14 to the exposure position. During attachment or detachment of the photoconductor module PM, the photoconductor drum 12 is moved. Thus, the above-described retracted position is exactly defined as follows with reference to an installation position of the photoconductor drum 12. That is, the distance between the installation position where the photoconductor drum 12 is installed in the housing 42 of the printer 1 and the retracted position of the LPH unit 70 is larger than the distance between the installation position of the photoconductor drum 12 and the exposure position of the LPH unit 70. However, such an exact expression with reference to the installation position is not simple. Thus, in the following description, a simple expression such as "further away from the photoconductor drum 12" may be used to express the same meaning as that of the above-described exact expression.

The image forming units 11 has the same structure except for toner contained in the developing device 15. The image forming units 11 respectively form yellow (Y) toner images, magenta (M) toner images, cyan (C) toner images, and black (K) toner images.

The image formation processing section 10 also includes an intermediate transfer belt 20, first transfer rollers 21, a second transfer roller 22, and a fixing device 45. Toner images of the colors formed on the photoconductor drums 12 of the image forming units 11 for the respective colors are transferred onto the intermediate transfer belt 20 such that the toner images are superposed with one another. The toner images of the colors formed by the respective image forming units 11 are sequentially transferred onto the intermediate transfer belt 20 by the respective first transfer rollers 21. The toner images having been transferred and superposed with one another on the intermediate transfer belt 20 are collectively transferred onto a sheet of paper serving as a recording medium by the second transfer roller 22. The images having been transferred through second transfer are fixed onto the sheet by the fixing device 45.

In the printer 1, the image formation processing section 10 performs an image forming operation in accordance with various control signals supplied from the controller 30. That is, image data input from the PC 3 or the image reading apparatus 4 is subject to image processing performed by the image processor 35 under the control of the controller 30 and supplied to each image forming unit 11 through an interface (not illustrated). Then, for example, in the image forming unit 11K for black (K), the photoconductor drum 12 is charged to a predetermined potential by the charger 13 and exposed to light from the LPH 14 while being rotated in an arrow A direction. The LPH 14 emits light in accordance with part of data that represents an image of a black component out of the image data transmitted from the image processor 35. Thus, an electrostatic latent image relating to the black (K) image is formed on the photoconductor drum 12. The electrostatic latent image having been formed on the photoconductor drum 12 is developed by the developing device 15, thereby a black (K) toner image is formed on the photoconductor drum 12. Likewise, yellow (Y), magenta (M), and cyan (C) toner images are respectively formed by the image forming units 11Y, 11M, and 11C for the other colors.

The color toner images formed by the image forming units 11 are sequentially electrostatically attracted onto the intermediate transfer belt 20, which is moved in the arrow B direction, by using the first transfer rollers 21. The toners of the respective colors are superposed with one another to form a combined toner image. As the intermediate transfer belt 20 is moved, the combined toner image on the intermediate transfer belt 20 is transported to a region where the second transfer roller 22 is disposed (second transfer portion T). The sheet is supplied from a sheet holding unit 40 to the second transfer portion T at a timing at which the combined toner image is transported by the intermediate transfer belt 20. The entire combined toner image is electrostatically transferred onto the transported sheet by using a transfer electric field generated in the second transfer portion T by the second transfer roller 22.

After that, the sheet, onto which the combined toner image has been electrostatically transferred, is removed from the intermediate transfer belt 20 and transported to the fixing device 45. The fixing device 45 performs a fixing process, in which heat and pressure are applied, on the combined toner image on the sheet having been transported to the fixing device 45, thereby fixing the combined toner image onto the sheet. Then, the sheet, on which the fixed image has been formed, is transported to an ejected sheet stacking unit 41 provided in a sheet ejecting section of the printer 1.

The toner still attracted to the intermediate transfer belt 20 after second transfer has been performed (residual toner after transfer) is removed from the surface of the intermediate transfer belt 20 by a belt cleaner 25 after the second transfer has been performed, so that another image formation cycle is prepared. Thus, the image formation in the printer 1 is repeated as many cycles as the number of prints.

Figure 2:
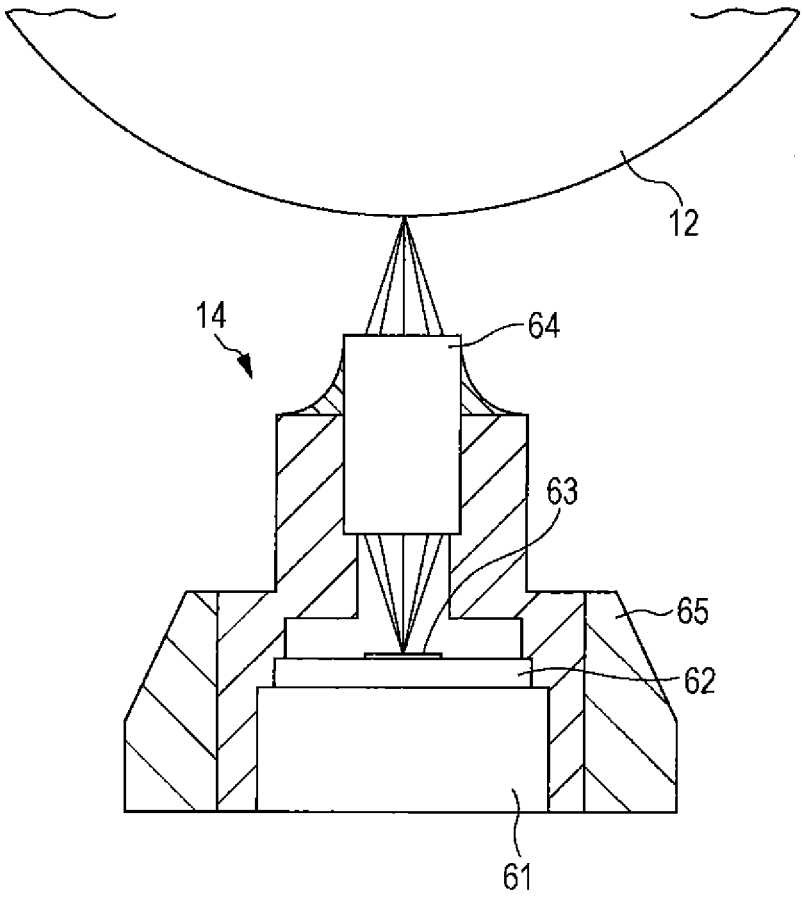
FIG. 2 is a sectional view of the structure of an LED print head (LPH)

FIG. 2 is a sectional view of the structure of the LPH 14.

The LPH 14 is disposed below each of the photoconductor drums 12 in the printer 1 illustrated in FIG. 1 and emits light from below to expose the photoconductor drum 12 to the light.

As illustrated in FIG. 2, the LPH 14 includes a housing 61, an LED array 63, an LED circuit board 62, a rod lens array 64, and a holder 65.

The housing 61 is formed of a sheet or block made of a metal such as aluminum or stainless steel and supports the LED circuit board 62.

The LED array 63, a signal generating circuit that drives the LED array 63, and the like are disposed on the LED circuit board 62.

The rod lens array 64 forms an image of the light from the LED array 63 on the surface of the photoconductor drum 12. The rod lens array 64 is disposed in the axial direction of the photoconductor drum 12 and has a width in the rotational direction of the photoconductor drum 12. The rod lens array 64 includes plural gradient index lenses arranged therein to form an erect real image of unity-magnification.

The holder 65 has an elongated shape and is disposed in the axial direction of the photoconductor drum 12. The holder 65 supports the housing 61 and the rod lens array 64 and shields the LED array 63 from the outside. Thus, dust from the outside is unlikely to adhere to the LED array 63. The holder 65 supports the rod lens array 64 such that light emitting points of the LED array 63 match the focal planes of the rod lens array 64.

Here, attachment and detachment of the above-described photoconductor module PM and a movement of the LPH 14 are described in detail.

Figure 3:
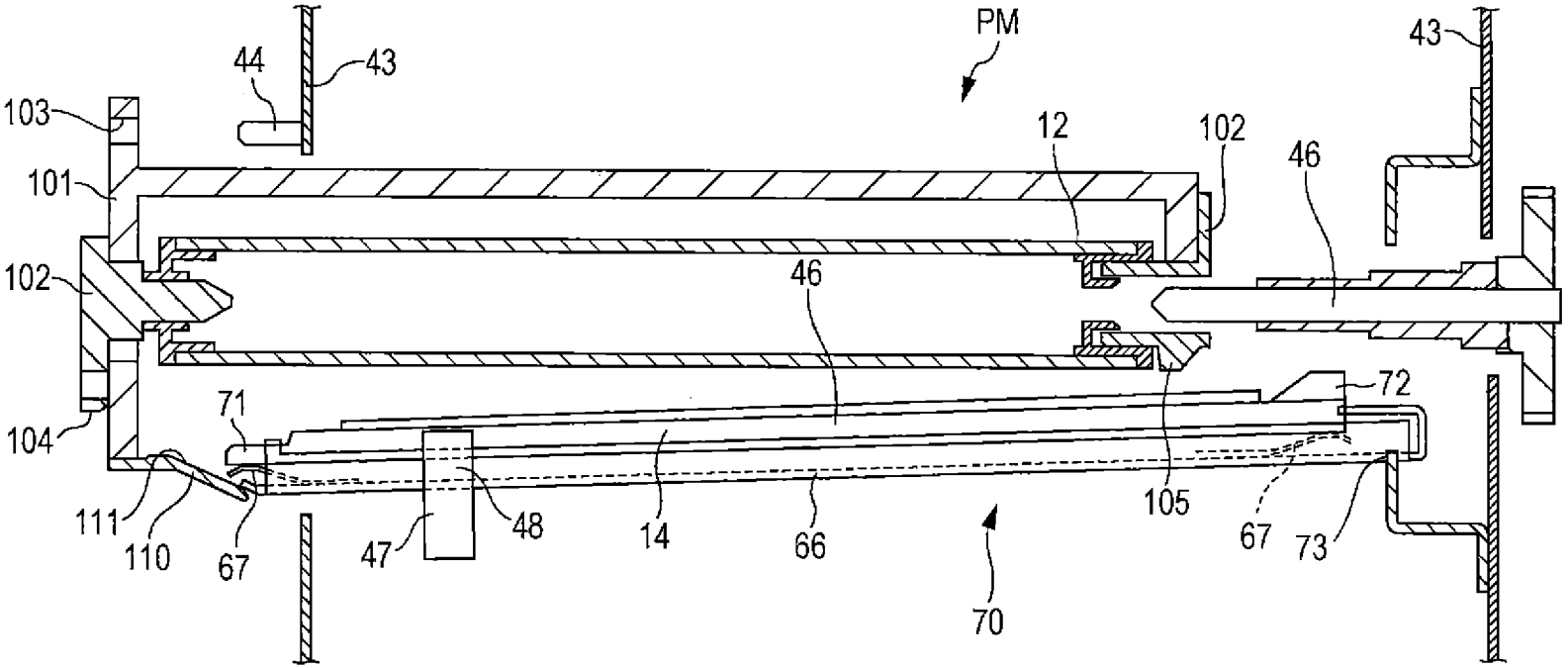
FIG. 3 is a sectional view of a state in which the LPH is at a retracted position.
Figure 4:
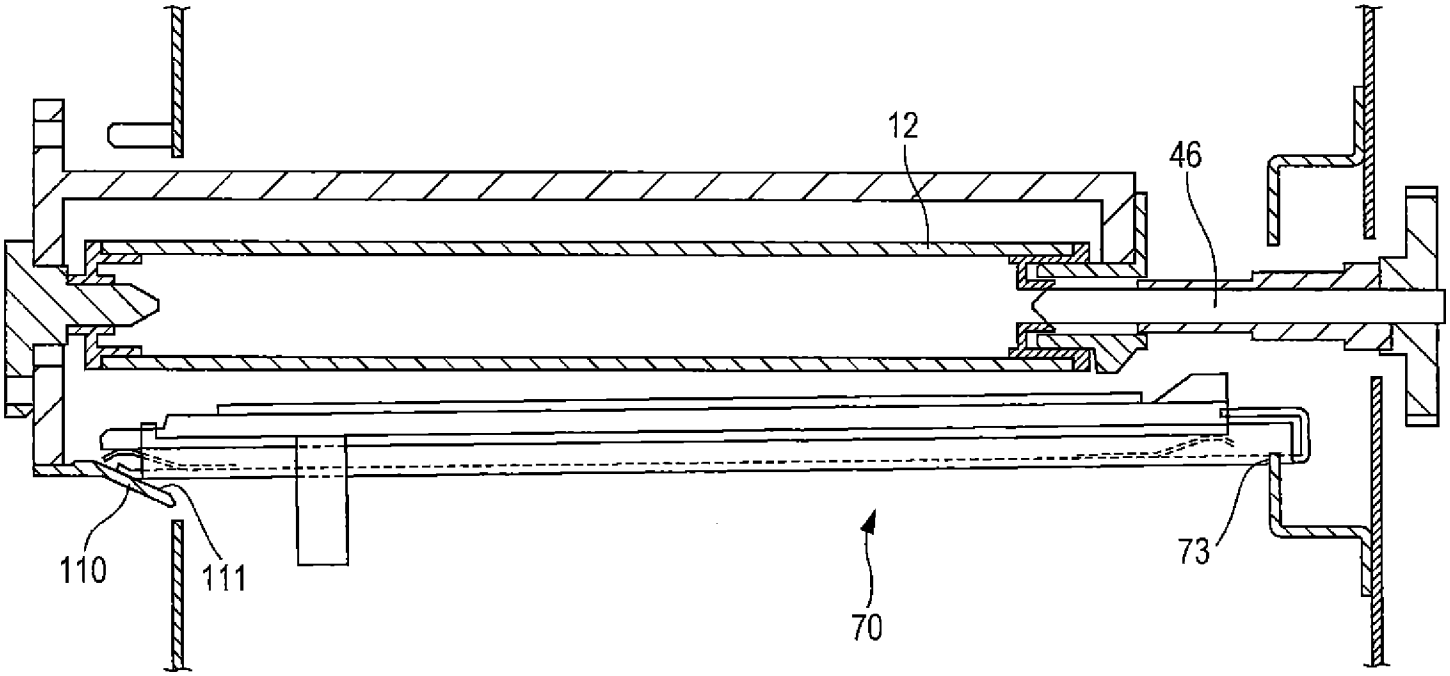
FIG. 4 is a sectional view of a first intermediate state in which the LPH is at a position in a movement from the retracted position to an exposure position.
Figure 5:
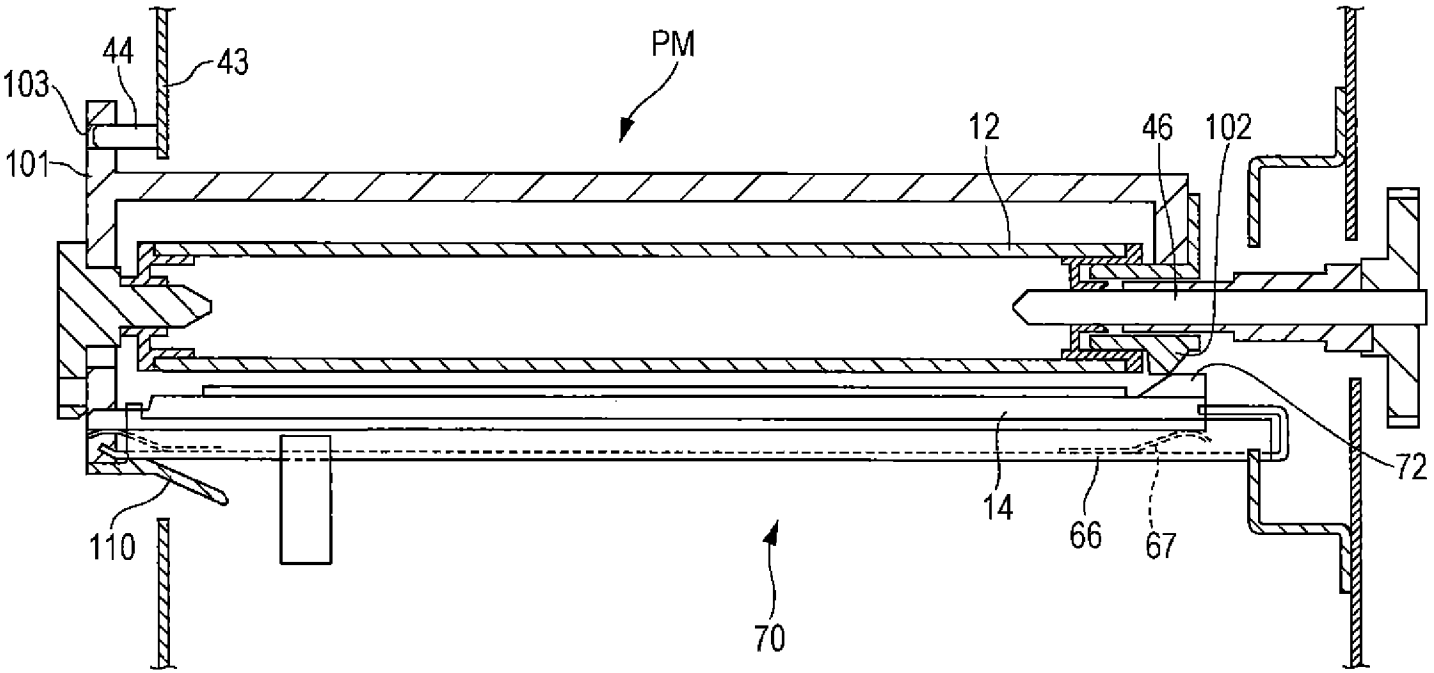
FIG. 5 is a sectional view of a second intermediate state in which the LPH is at a position in the movement from the retracted position to the exposure position.
Figure 6:
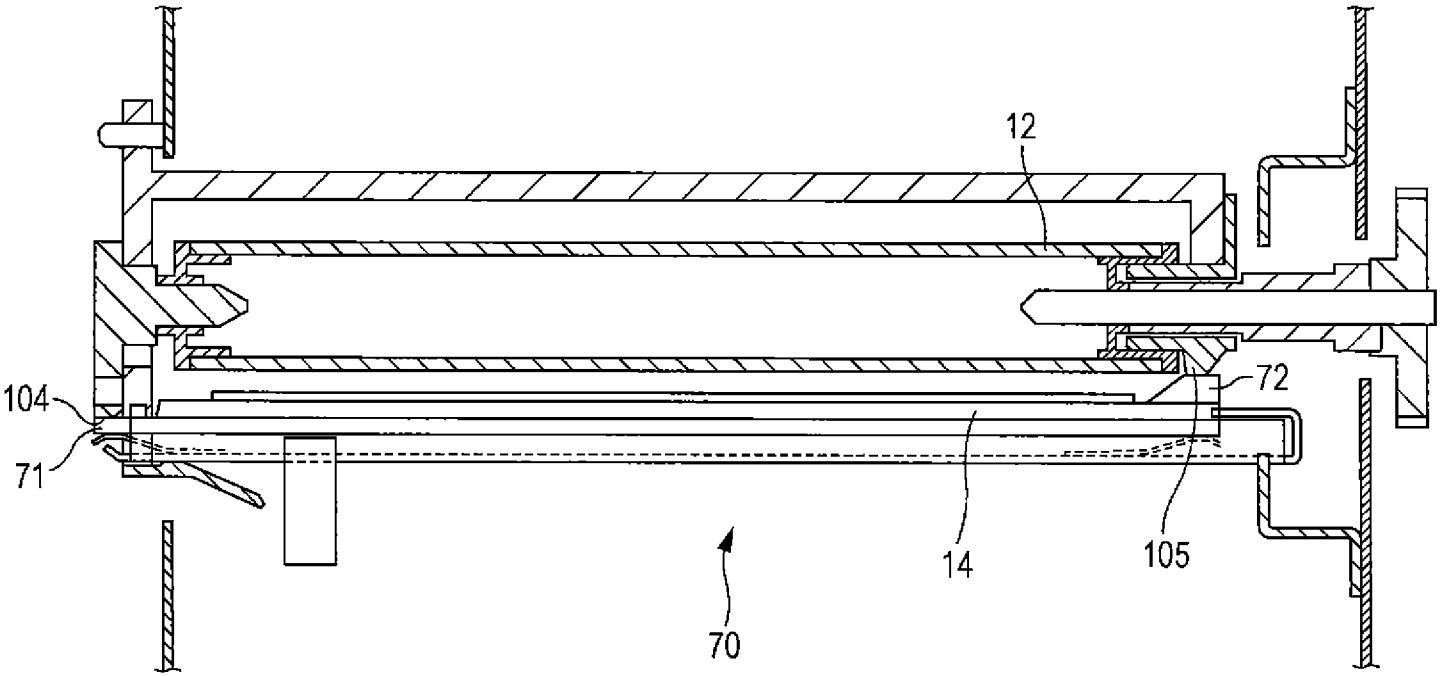
FIG. 6 is a sectional view of a state in which the LPH is at the exposure position.

FIG. 3 is a sectional view of a state in which the LPH is at the retracted position. FIGS. 4 and 5 are sectional views of intermediate states in which the LPH is at positions of a movement from the retracted position to the exposure position. FIG. 6 is a sectional view of a state in which the LPH is at the exposure position.

In FIGS. 3 to 6, the right side corresponds to the rear side of the printer and a leading side in an insertion direction of the photoconductor module PM; and the left side corresponds to the front side of the printer and a trailing side in the insertion direction.

The photoconductor drum 12 is disposed in a housing 101 of the photoconductor module PM. Sleeves 102 hold the photoconductor drum 12 such that the photoconductor drum 12 is interposed between the sleeves 102 on the rear and the front sides. A bearing and the rotational shaft of the photoconductor drum 12 are disposed in the sleeve 102 on the front side. The sleeve 102 on the rear side holds the rear side of the photoconductor drum 12 as illustrated in FIG. 3 when the photoconductor module PM is removed from the printer 1. The housing 101 has a drawing arm 110. The drawing arm 110 obliquely projects from the housing 101 so as to face the leading side in the insertion direction of the photoconductor module PM and the LPH unit 70 side. The drawing arm 110, which is secured to the housing 101, has an inclined surface 111. The drawing arm 110 corresponds to an example of a movement device of the present invention. In the present exemplary embodiment, the drawing arm 110 has a simple structure in which a member obliquely projects from the housing 101. The movement device having such a simple structure is unlikely to cause failures, is durable, has a long life, and is easily manufactured.

As describe above, a metal frame portion 43 is disposed in the printer 1. A drive shaft 46, which rotates the photoconductor drum 12, projects from the rear side of the frame portion 43 toward the photoconductor drum 12. A positioning boss 44 projects from the front side of the frame portion 43 to a side further to the front than the frame portion 43. The photoconductor module PM is positioned relative to the frame portion 43 by engaging the positioning boss 44 and a positioning hole 103 of the housing 101 with each other.

The LPH unit 70 includes the LPH 14 and a holding body 66, in which a flat spring 67 that pushes the LPH 14 toward the photoconductor drum 12 is disposed. The holding body 66 corresponds to an example of a holding body of the present invention, the flat spring 67 corresponds to an example of an urging member of the present invention, and the LPH 14 corresponds to an example of a light source of the present invention.

In the state illustrated in FIG. 3, the LPH unit 70 is at the retracted position and supported by a support 47. Although it is not illustrated, the support 47 is secured to the frame portion 43 of the housing 42. The support 47 has an extended portion 48 that extends upward in FIG. 3. The LPH unit 70 is interposed between parts of the extended portion 48, the parts being on the front and rear sides of the page of FIG. 3. An end portion of the LPH unit 70 on the rear side is hooked in the frame portion 43. A position where the LPH unit 70 is hooked in the frame portion 43 serves as a fulcrum 73, about which the LPH unit 70 is rotatable in the up-down direction in FIG. 3. The LPH unit 70 is guided by the extended portion 48 of the support 47 while rotating as described above.

The LPH 14 of the LPH unit 70 has two datums, that is, a datum 71 on the front side and a datum 72 on the rear side. The datums 71 and 72 correspond to examples of a contact portion of the present invention. Two sleeves 102 of the photoconductor module PM each have an LPH receiving surface, that is, an LPH receiving surface 104 on the front side and an LPH receiving surface 105 on the rear side. The LPH receiving surfaces 104 and 105 correspond to examples of a reference surface of the present invention.

The photoconductor module PM is removed from or inserted into the printer 1 by the user for, for example, replacement of the photoconductor drum 12 at the end of its life. The photoconductor module PM is guided by a guide rail (not shown) during attachment or detachment thereof.

When the photoconductor module PM is inserted into the printer 1, a tip end of the drawing arm 110 projecting from the housing 101 is, as illustrated in FIG. 3, brought into contact with the holding body 66 of the LPH unit 70. Thus, the LPH unit 70 is moved onto the inclined surface 111 of the drawing arm 110.

When the photoconductor module PM in the state illustrated in FIG. 3 is further pushed into the printer 1, the front side of the LPH unit 70 is, as illustrated in FIG. 4, moved up along the inclined surface 111 of the drawing arm 110 and rotated about the fulcrum 73. Also, the drive shaft 46 is connected to the photoconductor drum 12. As illustrated in FIG. 4, the drawing arm 110 provided in the photoconductor module PM causes the the LPH unit 70 to move from the retracted position side to the exposure position side along with the movement of the photoconductor module PM being inserted into the printer 1. This reduces the number of operations performed by the user because the user does not perform an operation for moving the LPH unit 70 to the exposure position other than an operation of inserting the photoconductor module PM.

When the photoconductor module PM in the state illustrated in FIG. 4 is further pushed into the printer 1, as illustrated in FIG. 5, the LPH unit 70 is pulled up to the base of the drawing arm 110 on the front side. Furthermore, the positioning boss 44 that projects from the frame portion 43 of the housing 42 is fitted into the positioning hole 103 of the housing 101. Thus, the photoconductor module PM is positioned relative to the frame portion 43 of the housing 42. On the rear side, the datum 72 of the LPH unit 70 is brought into contact with the sleeve 102, thereby the LPH 14 is pushed into the holding body 66 while resisting the force exerted by the flat spring 67. Also, the drive shaft 46 enters the photoconductor drum 12, thereby positioning the photoconductor drum 12.

When the photoconductor module PM has been completely inserted into the printer 1, the datums 71 and 72 respectively provided on the front and rear sides of the LPH unit 70 are, as illustrated in FIG. 6, in contact with the LPH receiving surfaces 104 and 105 respectively provided on the front and rear sides of the photoconductor module PM. As described above, this is a simple method in which the specific portions of the LPH unit 70 are brought into contact with the specific surfaces of the photoconductor module PM. Despite this, the distance between the LPH 14 and the photoconductor drum 12 are appropriately set for exposure, and the LPH unit 70 is highly accurately positioned at the exposure position. Compared to the above-described highly accurate positioning at the exposure position, accuracy of the movement of the LPH unit 70 using the drawing arm 110 is low. However, since the LPH 14 is pushed into the holding body 66 while resisting the force exerted by the flat spring 67, the flat spring 67 absorbs the difference in the accuracy.

When the photoconductor module PM is removed from the printer 1, the LPH unit 70 is moved to the retracted position while the state of the LPH unit 70 is changed from the state illustrated in FIG. 6 to the states illustrated in FIGS. 5, 4 and 3 in this order. In this movement, the LPH unit 70 is moved along the inclined surface 111 of the drawing arm 110 and guided by the extended portion 48 of the support 47. The force that causes the above-described movement is gravity. In the present exemplary embodiment, a mechanism, an urging member, or the like is not particularly used to generate a force that causes the LPH unit 70 to move to the retracted position.

Positioning of the LPH 14 at the exposure position is described more in detail.

Figure 7:
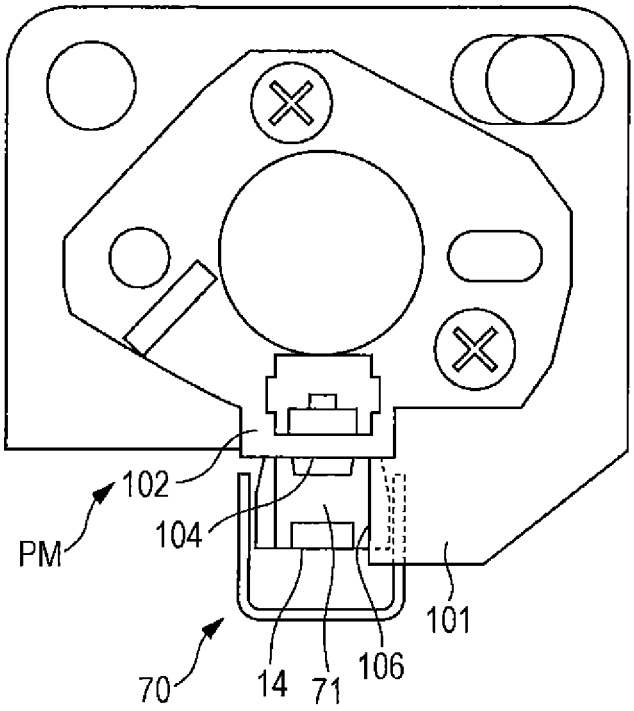
FIG. 7 illustrates positioning with respect to the rotational direction of a photoconductor drum on the front side of the LPH.

FIG. 7 illustrates positioning with respect to the rotational direction of the photoconductor drum 12 on the front side of the LPH 14.

In FIG. 7, the LPH unit 70 and the photoconductor module PM are seen from the front side.

The datum 71 on the front side of the LPH 14 of the LPH unit 70 is, as described above, in contact with the LPH receiving surface 104 of the sleeve 102 and also in contact with an LPH receiving surface 106 provided in the housing 101. Since the front side of the LPH 14 is in contact with the LPH receiving surface 106 of the housing 101, the front side of the LPH 14 is highly accurately positioned with respect to the rotational direction of the photoconductor drum 12.

Figure 8:
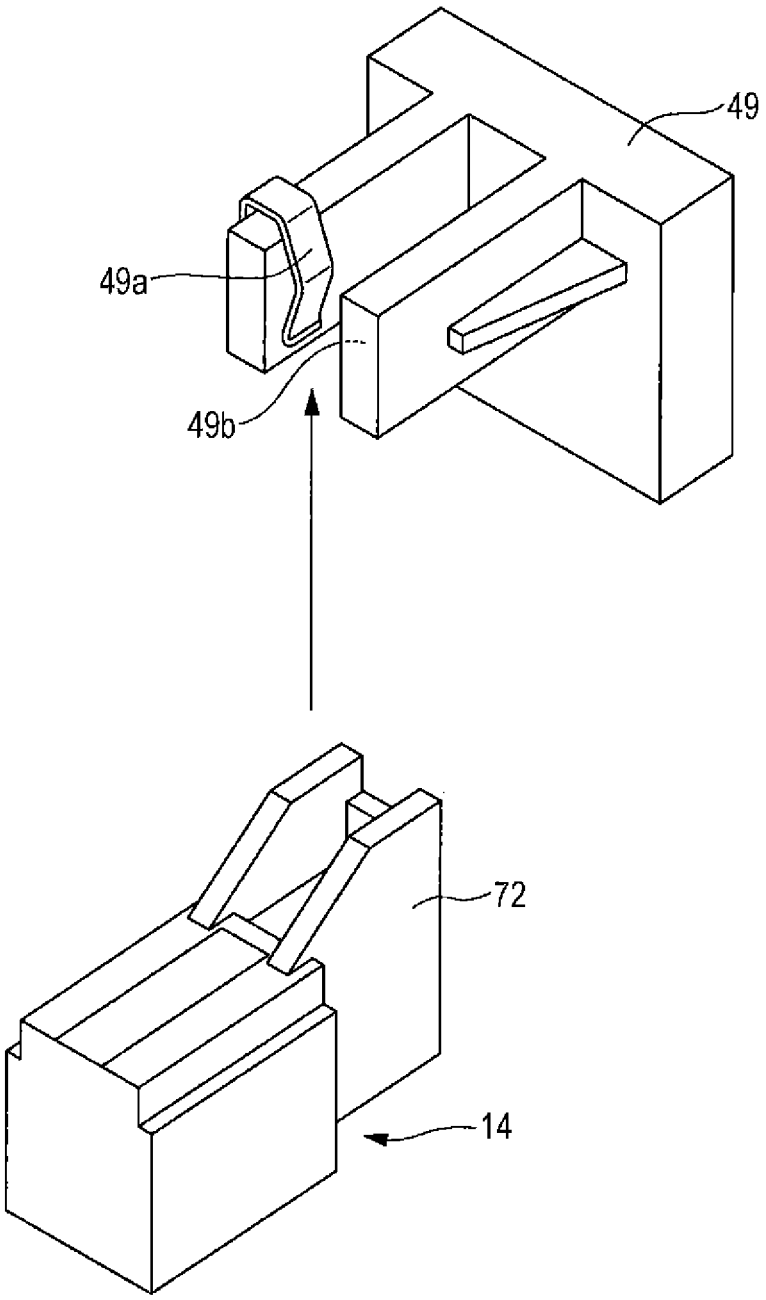
FIG. 8 illustrates positioning with respect to the rotational direction of the photoconductor drum on the rear side of the LPH.

FIG. 8 illustrates positioning with respect to the rotational direction of the photoconductor drum 12 on the rear side of the LPH 14.

A positioning member 49 illustrated in FIG. 8 is secured to the frame portion 43 on the rear side of the housing 42.

When the datum 72 of the LPH 14 on the rear side is interposed between parts of the positioning member 49, the datum 72 is pressed by a spring 49*a*. This causes the datum 72 to be brought into contact with a receiving surface 49*b*. Thus, the rear side of the LPH 14 is highly accurately positioned with respect to the rotational direction of the photoconductor drum 12.

Figure 9:
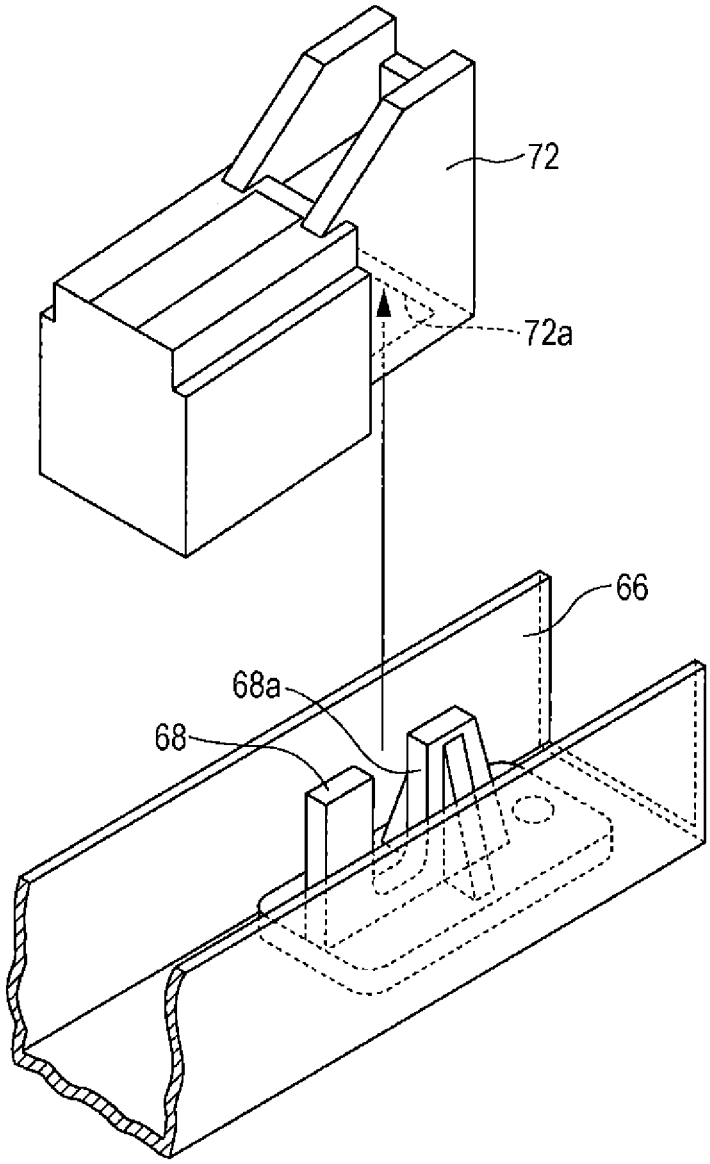
FIG. 9 illustrates positioning of the LPH with respect to the axial direction of the photoconductor drum.

FIG. 9 illustrates positioning of the LPH 14 with respect to the axial direction of the photoconductor drum 12.

A positioning member 68 illustrated in FIG. 9 is secured in the holding body 66 of the LPH unit 70. An edge 72*a* is provided in the datum 72, which is disposed on the rear side of the LPH 14. The edge 72*a* is fitted into a groove 68*a* provided in the positioning member 68, thereby positioning the LPH 14 with respect to the axial direction of the photoconductor drum 12. The LPH 14 is displaced relative to the holding body 66 within a range allowed by deformation of the aforementioned flat spring 67. The edge 72*a* of the datum 72 is constantly fitted in the groove 68*a* of the positioning member 68 when the LPH 14 is within the allowed displacement range. The holding body 66 of the LPH unit 70 is positioned with respect to the axial direction of the photoconductor drum 12 at the aforementioned fulcrum 73.

Here, description of the exemplary embodiment is completed.

In the above description, the tandem-type color printer is described as the exemplary embodiment of the image forming apparatus according to the present invention. However, the image forming apparatus according to the present invention may be a revolver-type color printer or a monochrome printer. Furthermore, the image forming apparatus according to the present invention may be applied to an apparatus other than a printer such as a copier, a facsimile machine, or a multifunction machine.

Also in the above description, the drawing arm 110 secured to the housing 101 is described as the example of the movement device of the present invention. However, the movement device according to the present invention may be an operational mechanism that is not secured.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a housing;

an image carrying body having a surface, the image carrying body being installed in the housing, the image carrying body carrying an image formed on the surface thereof;

an exposure device that is movable between an exposure position and a retracted position, the surface of the image carrying body being exposed to light at the exposure position, a distance between an installation position where the image carrying body is installed in the housing and the retracted position being larger than a distance between the installation position and the exposure position;

a detachable body, the image carrying body being disposed in the detachable body, the detachable body attachable to and detachable from the housing; and a movement device provided in the detachable body, the movement device causing the exposure device to move from the retracted position side to the exposure position side along with a movement of the detachable body being inserted into the housing, the movement device having an inclined surface with respect the surface of the image carrying body, and the inclined surface coming into contact with the exposure device causing the exposure device to move from the retracted position side to the exposure position side.

2. The image forming apparatus according to claim 1, wherein the exposure device has a leading portion and a trailing portion that are respectively on a leading side and a trailing side in an insertion direction of the detachable body, wherein the trailing portion of the exposure device is rotated about a fulcrum near the leading portion, and wherein the exposure device is movable between the exposure position and the retracted position through the rotation.

3. An image forming apparatus comprising:

a housing;

an image carrying body having a surface, the image carrying body being, installed in the housing, the image carrying body carrying an image formed on the surface thereof;

an exposure device that is movable between an exposure position and a retracted position, the surface of the image carrying body being exposed to light at the exposure position, a distance between an installation position where the image carrying body is installed in the housing and the retracted position being larger than a distance between the installation position and the exposure position;

a detachable body, the image carrying body being disposed in the detachable body, the detachable body attachable to and detachable from the housing; and a movement device provided in the detachable body, the movement device causing the exposure device to move from the retracted position side to the exposure position side along with a movement of the detachable body being inserted into the housing, wherein the exposure device is moved from the exposure position side to the retracted position side by gravity and from the retracted position side to the exposure position side by using the movement device.

4. An image forming apparatus comprising:

a housing;

an image carrying body having a surface, the image carrying body being installed in the housing, the image carrying body carrying an image formed on the surface thereof;

an exposure device that is movable between an exposure position and a retracted position, the surface of the image carrying body being exposed to light at the exposure position, a distance between an installation position where the image carrying body is installed in the housing and the retracted position being larger than a distance between the installation position and the exposure position;

a detachable body, the image carrying body being disposed in the detachable body, the detachable body attachable to and detachable from the housing; and a movement device provided in the detachable body, the movement device causing the exposure device to move from the retracted position side to the exposure position side along with a movement of the detachable body being inserted into the housing, wherein the movement device obliquely projects from the detachable body to the exposure device side and to a leading side in an insertion direction of the detachable body, and wherein, as the detachable body is inserted, the movement device is brought into contact with the exposure device so as to cause the exposure device to move to the image carrying body side.

5. An image forming apparatus comprising:

a housing;

an image carrying body having a surface, the image carrying body being installed in the housing, the image carrying body carrying an image formed on the surface thereof;

an exposure device that is movable between an exposure position and a retracted position, the surface of the image carrying body being exposed to light at the exposure position, a distance between an installation position where the image carrying body is installed in the housing and the retracted position being larger than a distance between the installation position and the exposure position;

a detachable body, the image carrying body being disposed in the detachable body, the detachable body attachable to and detachable from the housing; and a movement device provided in the detachable body, the movement device causing the exposure device to move from the retracted position side to the exposure position side along with a movement of the detachable body being inserted into the housing, wherein the exposure device has a contact portion and the detachable body has a reference surface, and wherein the contact portion is brought into contact with the reference surface so that the exposure device is positioned at the exposure position.

6. The image forming apparatus according to claim 5, wherein the exposure device includes a light source that emits light to which the image carrying body is exposed, an urging member that urges the light source to the image carrying body side, and a holding body that holds the light source through the urging member, and wherein, as the detachable body is inserted into the housing, the movement device is brought into contact with the holding body of the exposure device so as to cause the holding body to move to the image carrying body side.

* * * * *